US005379472A

United States Patent [19]

Aittomäki

[11] Patent Number: 5,379,472

[45] Date of Patent: Jan. 10, 1995

[54] MATTRESS

[76] Inventor: Samuel S. Aittomäki, Kuutamokatu 4 A 1, 02210 Espoo, Finland

[21] Appl. No.: 60,359

[22] Filed: May 11, 1993

[30] Foreign Application Priority Data

May 15, 1992 [FI] Finland ..... 922248

[51] Int. Cl.[6] ..... A47C 27/04

[52] U.S. Cl. ..... 5/476; 5/464; 5/659

[58] Field of Search ..... 5/475, 476, 464, 659

[56] References Cited

U.S. PATENT DOCUMENTS

| | | | |
|---|---|---|---|
| 2,072,570 | 3/1937 | Smith | 5/475 |
| 3,125,768 | 3/1964 | Rickert | 5/659 |
| 4,365,371 | 12/1982 | Boussaroque | 5/464 |
| 4,476,594 | 10/1984 | McLeod | 5/464 |
| 4,559,659 | 12/1985 | Foster | 5/236.1 |
| 4,685,658 | 8/1987 | Keown | 5/236.1 |
| 4,696,070 | 9/1987 | Degen | 5/236.1 |
| 4,811,439 | 3/1989 | Siegel et al. | 5/475 |
| 4,999,868 | 3/1991 | Kraft | 5/475 |
| 5,040,255 | 8/1991 | Barber, Jr. | 5/475 |

FOREIGN PATENT DOCUMENTS

| | | |
|---|---|---|
| 146752 | 6/1980 | Denmark . |
| 0068766 | 1/1983 | European Pat. Off. . |
| 49108 | 8/1969 | Finland . |
| 73359 | 3/1985 | Finland . |
| 872472 | 12/1988 | Finland . |
| 843092 | 8/1989 | Finland . |
| 885663 | 6/1990 | Finland . |
| 1940763 | 12/1971 | Germany . |
| 2117333 | 9/1972 | Germany . |
| 595807 | 2/1978 | Switzerland . |
| 2037155 | 7/1980 | United Kingdom . |
| 8001981 | 10/1980 | WIPO . |

*Primary Examiner*—Michael J. Milano
*Attorney, Agent, or Firm*—Steinberg, Raskin & Davidson

[57] ABSTRACT

A mattress which includes at least two layers of a relatively soft material and a resilient intermediate layer arranged between the two layers having a lever effect so that deformation of the intermediate layer arising from a load on the mattress is permitted and so that when a person loads the mattress construction, forces arising from the load are transferred to the sides of the loading point, and the mattress construction is raised outside the loading point.

21 Claims, 12 Drawing Sheets $J_z = 0.05 d^4$ $J_z = \frac{h^3 b}{12}$

MATTRESS

BACKGROUND OF THE INVENTION

The present invention relates to an improved mattress for sleeping or the like.

In prior art mattress constructions, the resilient layer is almost exclusively formed of foamed plastic or foam rubber, spiral springs or combinations of the same, spiral springs that form a suspended face, or separate constructions formed by bags of water/air. It is a common feature of all of the resilient layers mentioned above that each of them are elastic at locations in the directions of the loads only. With the exception of the water or air mattresses, such prior art mattresses are hardly able to transfer the support of the load to other points in the transverse direction in the mattress. Thus, the support face becomes small, so that, as a result, high support forces and, thereby, high surface pressures are applied to the parts of the body lying on the mattress.

German Patent Application No. DE 1,940,763 describes a mattress construction which consists of a number of separate layers. In order to adjust the hardness of the mattress, it is possible to place a board that is made of a material that resists bending, such as wood, plastic, or plywood, between the layers. The dimensions of the board preferably correspond to the surface dimensions of the mattress. In practice, such a rigid board transfers forces in the mattress in a vertical direction only.

Denmark Patent Application No. DK 146,752 describes a mattress construction in which grooves are formed in inner foamed-plastic halves of the mattress. The grooved foamed-plastic layers are placed against each other so that the grooves are placed facing each other. The faces of the foamed-plastic halves have been fixed to each other by gluing them by means of an inelastic non-woven fabric. This construction transfers forces practically in a vertical direction only.

Finnish Patent No. FI 73,359 describes a mattress in which two surface layers of foamed plastics of different hardness grades have been joined together by means of a middle layer. The middle layer comprises sets of air ducts. When the mattress is turned around, two mattresses of different hardnesses are obtained. The middle layer equalizes the surface load over a wider area in the lower surface layer in the vertical direction.

Finnish Patent No. FI 49,108 describes a mattress in which a rigid, non-deformable board is placed inside an upper foamed-plastic layer. By means of the board, the surface forms of both of the mattress parts are affected.

In addition, Finnish Patent Application No. FI 843092 describes a mattress construction comprising a first and a second resilient support face, each of which is fixed to a rigidifying board that constitutes the middle part. The rigidifying board is composed of a number of pivotal parts in order to permit the rigidifying board to be deflected in one direction only. The pivotal parts also permit deflecting of the whole unit or rolling of the unit into a roll for storage.

A significant drawback of all of the mattress constructions mentioned above is the unequal surface pressure present in the mattress construction and the mere presence of vertical resilience without equalization of pressure in the horizontal direction. A further drawback of the prior art mattress constructions is the high and indefinite height of resilience. Moreover, the mattresses described in the above-mentioned references do not give the body a stabilizing support, which would reduce the surface pressures applied to the person.

OBJECTS AND SUMMARY OF THE INVENTION

It is an object of the present invention to provide a new and improved mattress construction by whose means the drawbacks of prior art constructions are substantially eliminated.

It is another object of the present invention to provide a new and improved mattress construction in which the resilience of the mattress is advantageous and in which an intermediate layer distributes the surface pressures over the body at a level required by the shape and the weight of the body at each particular point.

It is yet another object of the present invention to provide an intermediate layer of a mattress with spring members arranged both in the longitudinal direction of the mattress and in the transverse direction of the mattress.

In accordance with the invention, a mattress construction has been formed in which a separate resilient intermediate layer of adequate rigidity is arranged between two soft mattress parts. The intermediate layer is preferably made of spring steel and comprises elongate spring members arranged in a direction parallel to the transverse axis and/or, alternatively, to the longitudinal axis of the mattress. When a person loads the mattress, i.e., lies on the mattress, the resilient intermediate layer is deformed and transfers forces arising from the load upwards by a lever effect. In this manner, the surface pressures applied to the person are equalized. In addition, an adequate support is formed for the person who loads the mattress by means of the support construction constituting the intermediate layer, and particularly with respect to body parts placed at a higher level. The spring action of the spring members participates in this equalization with high capacity and high percentage.

By means of the construction of the present invention, a person lying on his side is given such a good support that the backbone is kept as a substantially straight line to thereby provide known benefits. Thus, the mattress construction of the invention is neither too hard nor too soft, and does not distort or force the backbone into a curved form. By means of the construction of the present invention, a support complying with the body is also obtained for the narrowest areas of the body, such as the waist. In this regard, the mattress construction in accordance with the invention comprises an intermediate layer operating by the lever effect in order to transfer loads from the heaviest parts of the body lying on the mattress horizontally to the sides. In such a case, support is transferred to the narrowest parts of the body, such as the lumbar region of the back. The mattress construction of the invention is easy to manufacture, and its weight is also relatively very low.

In the mattress construction in accordance with the invention, the mattress comprises a resilient intermediate layer structured and arranged between two layers of soft material to provide a lever effect. The intermediate layer is placed freely anywhere between the layers of soft material, whereby deformation of the intermediate layer, arising from the load, is permitted. In this manner, when a person loads the mattress construction, forces arising from the load are transferred to the sides of the loading point and the mattress construction is raised outside the loading point. The intermediate layer operates by means of a so-called lever effect, thereby shifting some of the vertical force effect in the lateral direction.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1B:
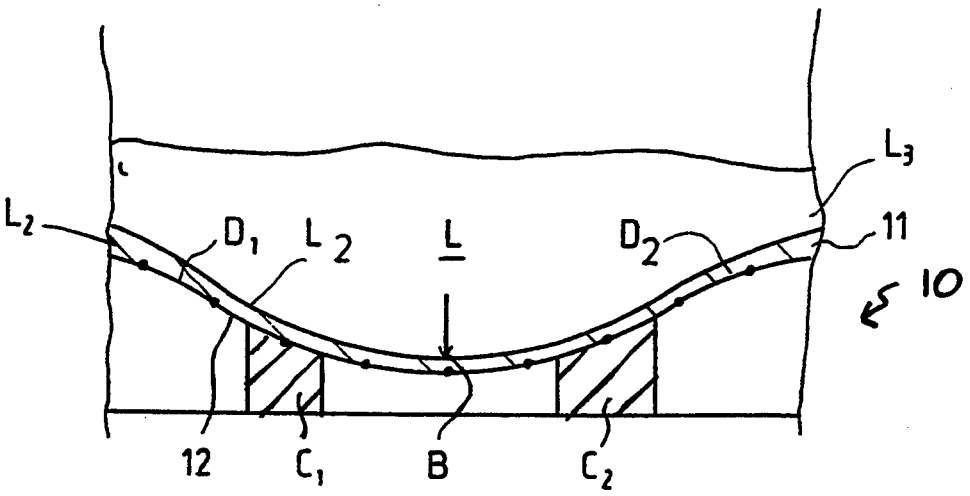
FIGS. 1A and 1B illustrate the operation of the intermediate layer of a mattress in accordance with the invention.
Figure 1A:
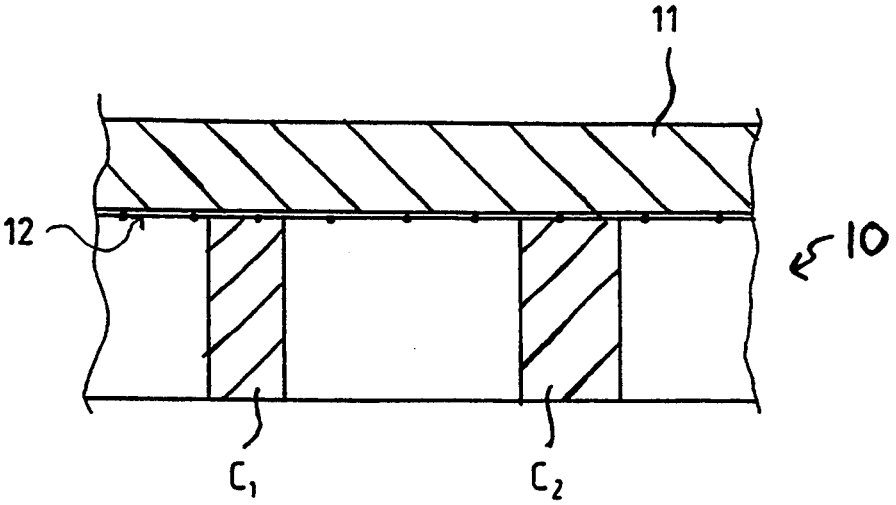

FIG. 1A illustrates the operation of a resilient lever-action intermediate layer 12 in a mattress 10 in accordance with the invention. FIG. 1A illustrates an unloaded situation wherein the resilient intermediate layer 12 is placed on lower support parts $C_1$,$C_2$ which are resilient in this particular embodiment. There is a layer 11 of soft material, also known as a soft material layer, on the intermediate layer 12.

FIG. 1B illustrates a loaded situation of the mattress in which a loading body part, such as the hip L, presses the intermediate layer 12 down. At both sides of the loading point B, a so-called lever effect is produced as ends $D_1$,$D_2$ of the resilient intermediate layer 12 attempt to raise the upper mattress construction 12 at both sides of the loading point B. Thus, by means of the intermediate layer, the body is also supported at its narrowest point $L_2$,$L_3$, so that the surface pressures applied to the loading person from the mattress 10 are equalized.

Figure 2B:
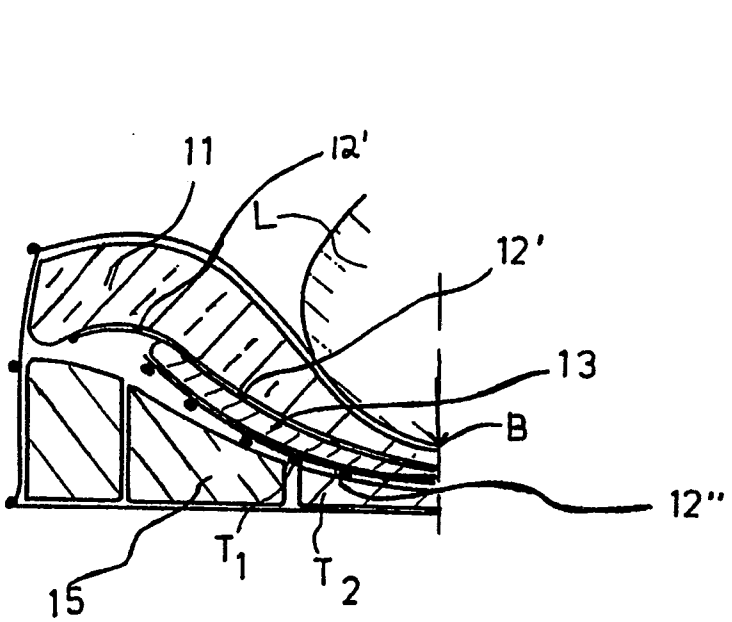
FIG. 2B illustrates the mattress construction of FIG. 2A when the mattress is loaded.
Figure 2A:
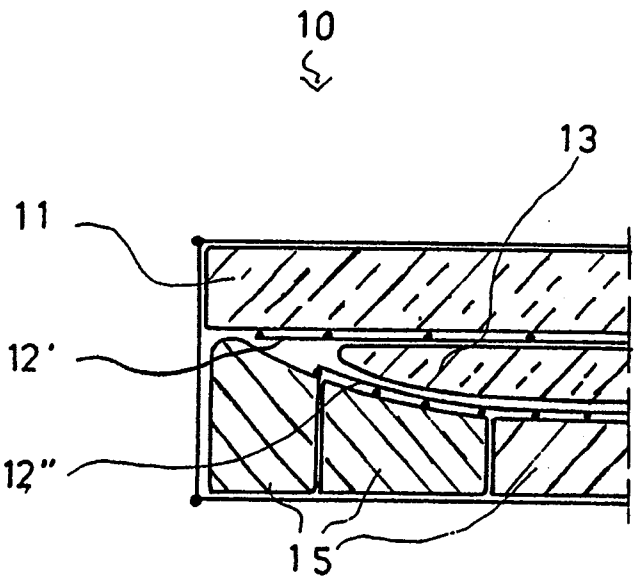
FIG. 2A illustrates the operation of a mattress similar to FIGS. 1A and 1B when a lower soft layer consists of a unified foamed-plastic material.

The mattress construction 10 shown in FIG. 2A comprises layers 11,13,15 of a soft material. The layers of soft construction operate in a similar manner to the support parts $C_1$,$C_2$ as shown in FIGS. 1A and 1B. Lower layers 13,15 are compacted around the loading point B at locations $T_1$,$T_2$. The compacted soft material $T_1$,$T_2$ forms support points for resilient and flexible intermediate layers 12',12". Thus, in a similar manner to the operation of the mattress as shown in FIGS. 1A and 1B, the intermediate layers 12',12" operate based on the lever effect and attempt to raise the upper layer 11,13 of soft material at both sides of the loading point B.

In this embodiment, in order that the intermediate layers 12',12" could be provided with adequate elastic properties, the intermediate layers 12', 12" are placed freely between the layers 11,13 and 13,15 of soft material. There are two intermediate layers in the embodiment of FIG. 2A, layers 12' and 12". However, the present invention is not limited to only two intermediate layers. Rather, there can be any amount of intermediate layers. The intermediate layers 12', 12" form a grille construction advantageously made of metal wire, preferably spring steel wire.

In FIG. 2A, the mattress is unloaded whereas in FIG. 2B, the mattress is in a loaded position caused by the loading body part, e.g., the hip L.

As shown in FIG. 2B, when the body L, which is usually the area of the hip, presses the intermediate layers down, the soft material in the layers 13 and 15 is compacted at both sides of the loading point B in the areas $T_1$,$T_2$ and forms support points for the resilient lever-action intermediate layers 12',12". In such a case, the edges of the intermediate layer 12',12" tend to rise and to act upwards with a force. Thus, also in the mattress construction shown in FIGS. 2A and 2B, a so-called lever effect is present, in which case the strain on the heaviest part of the body and the vertical downward loading are utilized in order to support the other parts of the body.

Figure 2C:
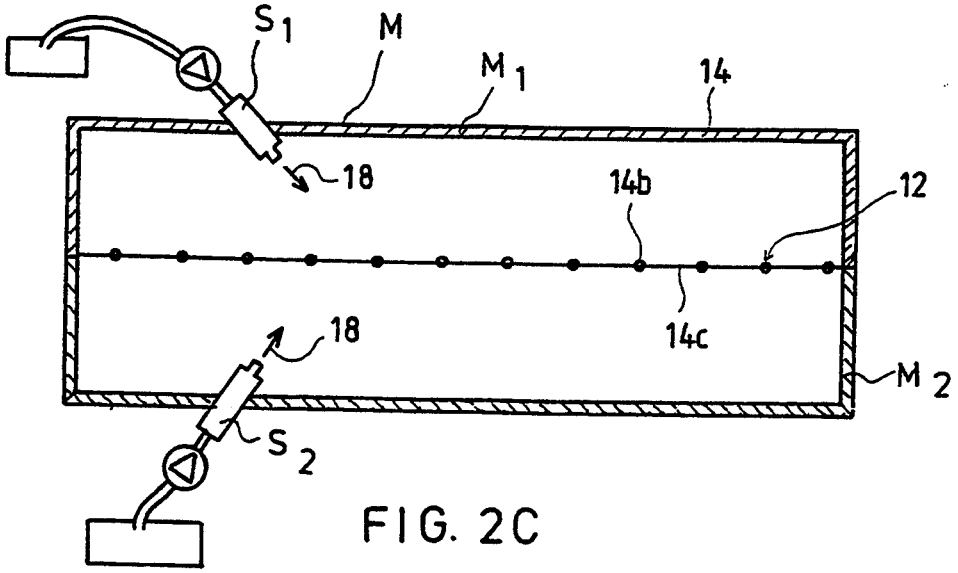
FIG. 2C illustrates the formation of the mattress construction in a mold by spraying the foamed-plastic layers to both sides of the intermediate layer.

In FIG. 2C, an embodiment of the invention is shown in which foamed plastic 18, for example polyurethane, is arranged in the interior of mold halves $M_1$ and $M_2$ of the mold M. The foamed plastic is sprayed out of nozzles $S_1$ and $S_2$ onto both sides of the intermediate layer 12. The intermediate layer may be a grille construction, similar to that shown in FIG. 3C, which comprises spring members, preferably elongate metal wires 14$a_1$,-14$a_2$ . . . , arranged parallel to the longitudinal axis X of the mattress. The intermediate layer also advantageously includes spring members, preferably metal wires 14$b_1$,14$b_2$ . . . , arranged parallel to the transverse axis Y of the mattress. In this embodiment, the intermediate layer 12 is not placed freely between the upper layer 11 of soft material and the layer 13 of soft material which joins the upper layer 11 through the intermediate layer. Rather, the intermediate layer is connected with the layers 11,13. The mattress construction is, however, resilient. Thus, in the construction, the so-called lever effect will also occur when the intermediate layer 12 is loaded.

Figure 2D:
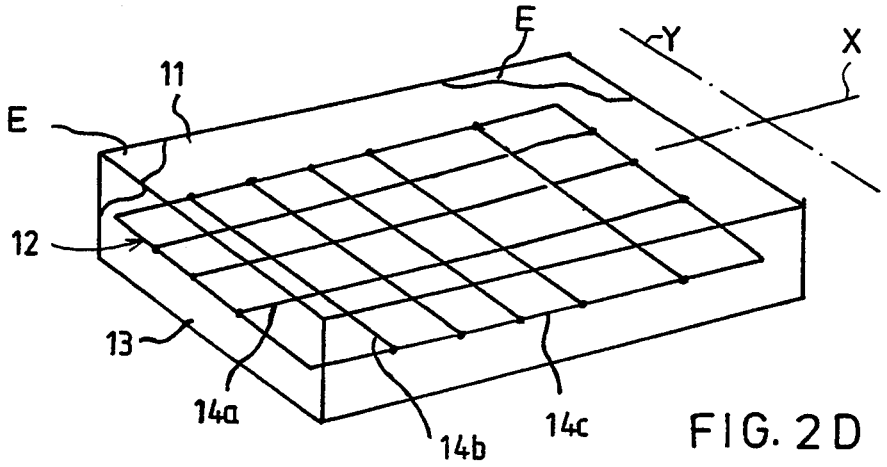
FIG. 2D illustrates a mattress construction prepared, e.g., by means of the method shown in FIG. 2C.

FIG. 2D shows a mattress 10 that has been manufactured by means of the method of FIG. 2C. The mattress 10 may additionally comprise a protective fabric E arranged around the mattress.

Figure 2E:
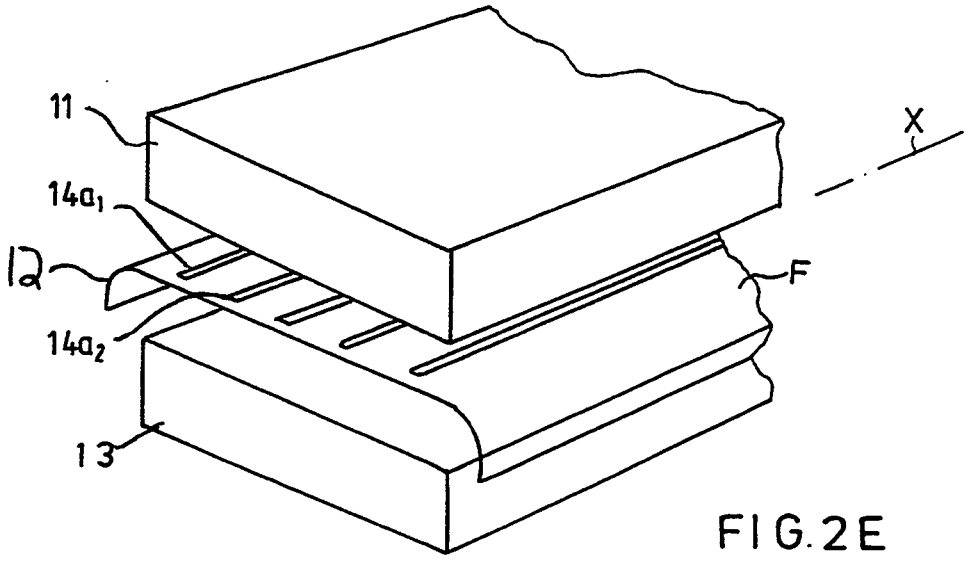
FIG. 2E illustrates an embodiment of the present invention in which the intermediate layer in the mattress consists of a suspended fabric to which spring members are fixed in a position parallel to the longitudinal axis of the mattress.

FIG. 2E shows an embodiment of the mattress construction of the present invention wherein the mattress 10 is shown as an exploded view. The intermediate layer 12 is composed of spring members 14$a_1$,14$a_2$ . . . arranged parallel to the longitudinal axis X of the mattress and connected to a fabric F. The intermediate layer 12 is placed between the upper layer 11 of soft material and the lower layer 13 of soft material.

Figure 3A:
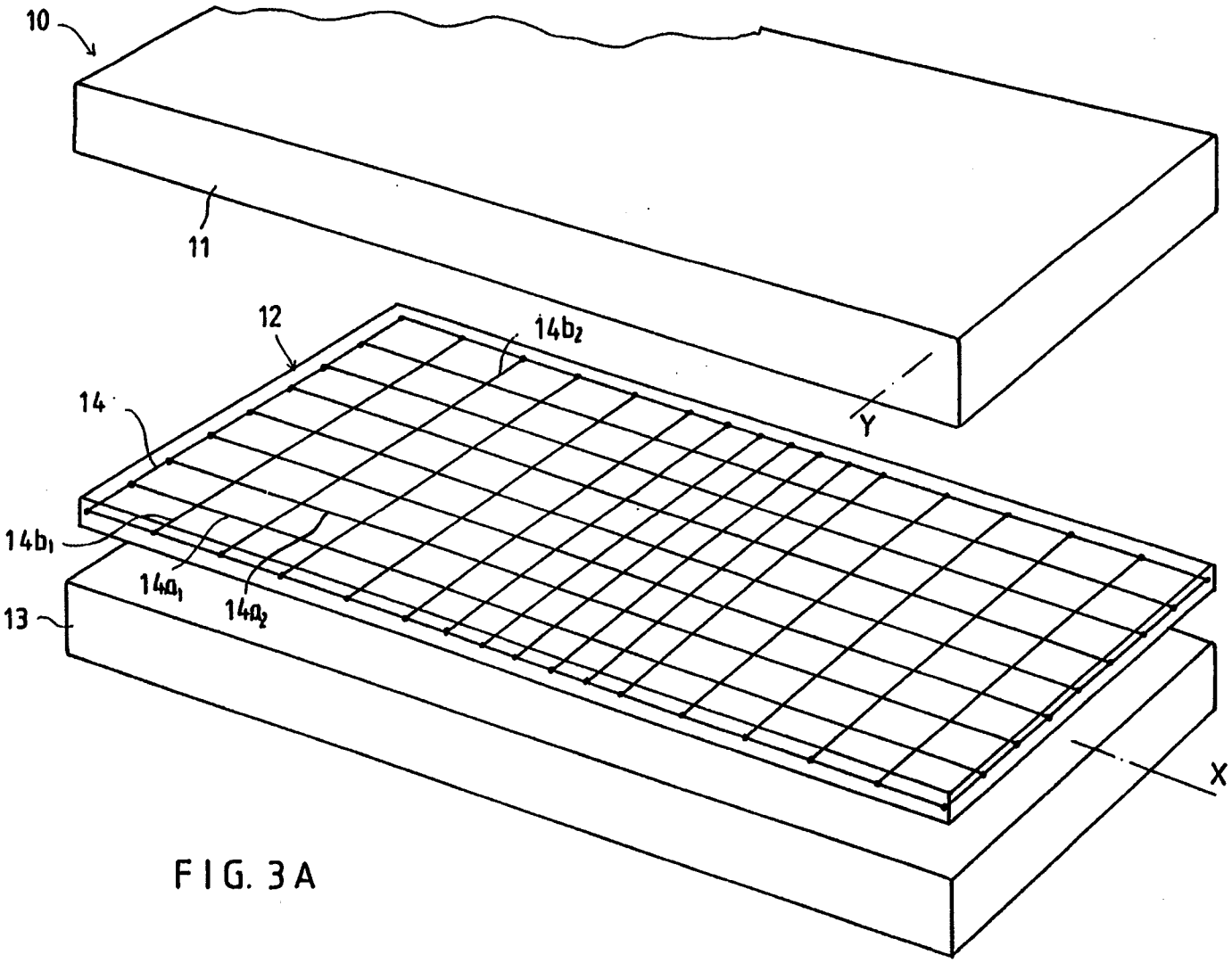
FIG. 3A illustrates an embodiment of the present invention in which the intermediate layer consists of transverse and longitudinal spring members.

FIG. 3A shows an embodiment of the mattress construction in accordance with the invention in which the mattress 10 comprises a first layer 11 of soft material and a second layer 13 of soft material. A resilient lever-action intermediate layer 12 in accordance with the invention is arranged between the first layer 11 and the second layer 13 As shown in FIG. 3A, the material of the second layer 13 supports and extends beneath the entire area of the intermediate layer 12.

The intermediate layer 12 preferably consists of spring members 14$a_1$,14$a_2$ . . . placed in the longitudinal direction of the mattress and spring members 14$b_1$, 14$b_2$ . . . arranged transverse to the mattress direction. The spring members 14*a*,14*b* are preferably spring steel wires having a substantially circular section. They may also be lamellar constructions, and made of plastic or other synthetic materials, for example they may be made of flat bar steel. In this embodiment of the invention, the resilient lever-action intermediate layer 12 is not fixed to any of the layers 11,13 of soft material placed in contact with it. This particular arrangement permits a free movement of deformation for the intermediate layer 12 resulting from loading of the mattress.

Figure 6A:
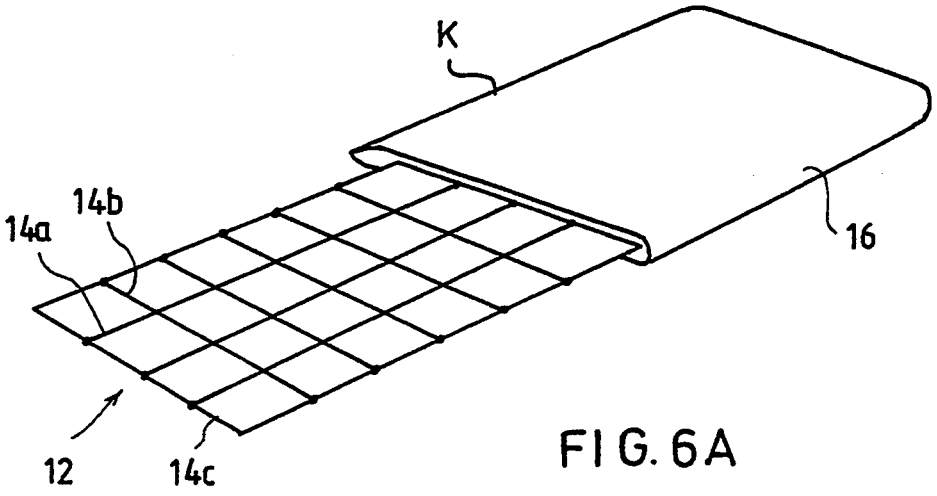
FIG. 6A illustrates the placement of the resilient support layer inside a bag construction consisting of a fabric in a mattress in accordance with the invention.

In order that the force and support produced by the lever effect could be transferred from the intermediate layer 12 to the upper layer 13 of soft material as uniformly as possible, the mattress construction is formed so that the spring members 14*a*, 14*b* of the intermediate layer 12 and the grille construction formed by these spring members are fitted inside a bag or equivalent made of a fabric (shown in FIG. 6A). In this manner, it is a particular advantage that a substantially uniform force and support are transferred from the intermediate layer 12 to the upper layer 13 of soft material.

Figure 3B:
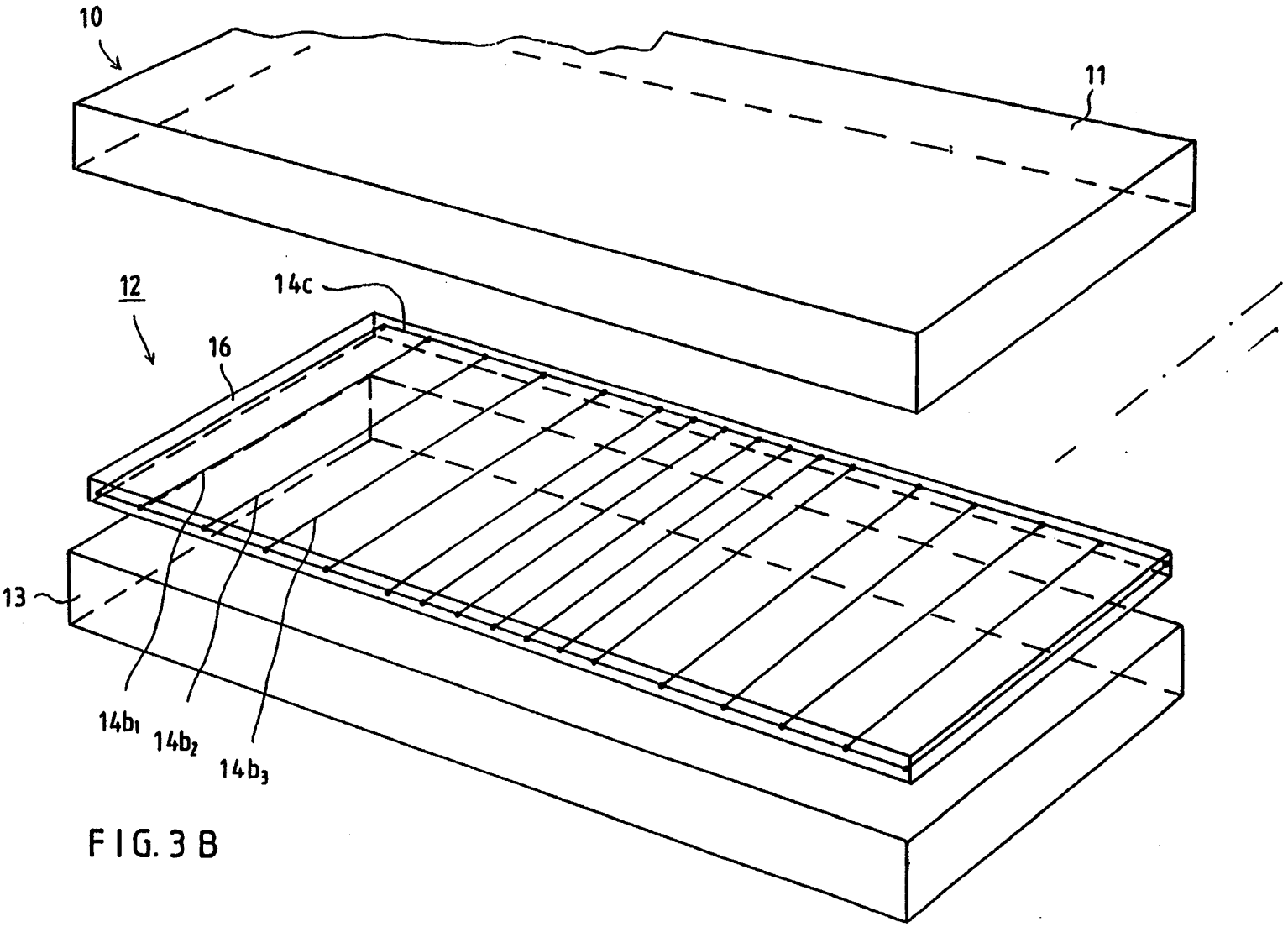
FIG. 3B illustrates an embodiment of the mattress construction in accordance with the present invention wherein the intermediate layer consists of transverse spring members only.

FIG. 3B illustrates a mattress construction in accordance with the invention as an axonometric exploded view. In this embodiment of the invention, the intermediate layer 12 comprises transverse spring members 14$b_1$,14$b_2$,14$b_3$ . . . only, it does not include the parallel longitudinal spring members 14$a_n$ . . . The intermediate layer 12 and its spring members are placed in a bag 16 made of a fabric.

The transverse direction of the mattress is the direction along the short side perpendicular to the principal direction of the elongate mattress. The longitudinal, or parallel, direction is considered for the purposes of this application to be the direction along the long side of the mattress parallel to the probable sleeping direction. However, the spring members 14$a_n$,14$b_n$ can be arranged in any position relative to the sleeping position.

Figure 3C:
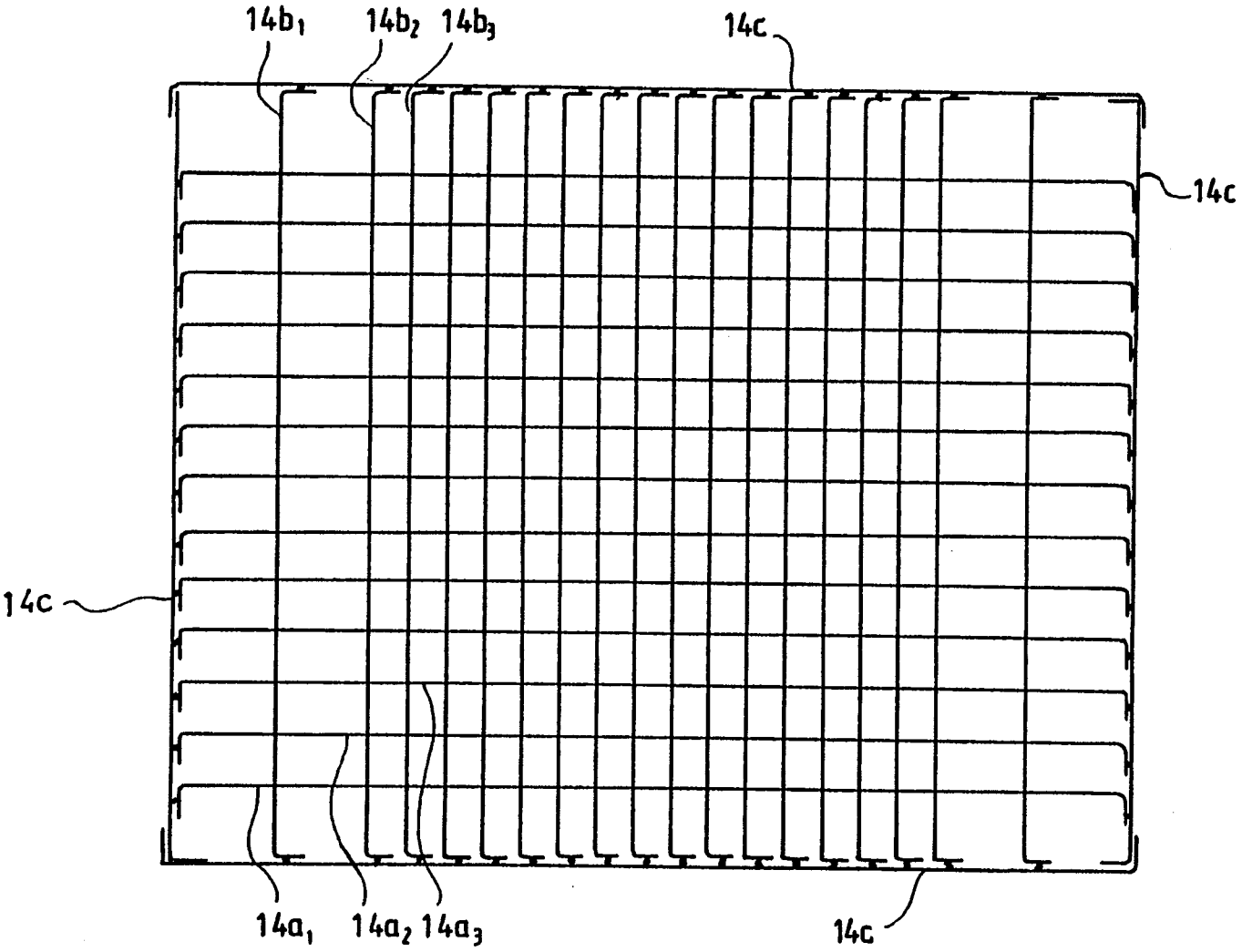
FIG. 3C is a top view of the intermediate layer wherein the spring members in the intermediate layer form a grille construction.

FIG. 3C is a top view of the intermediate layer 12 shown in FIG. 3A, which is a preferred embodiment of the intermediate layer. The intermediate layer 12 forms a latticework construction, a so-called grille construction. It consists of spring members 14$a_1$,14$a_2$ placed in the longitudinal direction (direction X) of the mattress and spring members 14$b_1$,14$b_2$, 14$b_3$ . . . placed in the transverse direction (direction Y) of the mattress. The spring members 14*a*,14*b* are connected to edge wires 14*c* at their ends only, for example, by means of loops, welding, or hook joints. The spring members 14*a*,14*b* are preferably made of spring steel, and particularly spring steel wires of circular section.

It is within the scope of the invention, to use an intermediate layer 12 that is made of lamellar members 14$a_1$,14$a_2$ . . . placed in the longitudinal direction of the mattress and of lamellar members 14$b_1$,14$b_2$ . . . , placed in the transverse direction of the mattress. The spring members 14*a*,14*b* are made of spring steel, plastic, or some other synthetic material. The spring members placed near the edges of the intermediate layer 12 are preferably made of a more rigid spring steel wire or an equivalent material, so that the support effect at the ends and at the sides is increased.

In addition, it is also possible to regulate the spacing of the spring members 14*a*,14*b* to place more spring members in locations which are more likely to be loaded, i.e., the center regions of the mattress, and less spring members in locations which will not receive a large part of the load, i.e., the ends of the mattress.

Figure 4A:
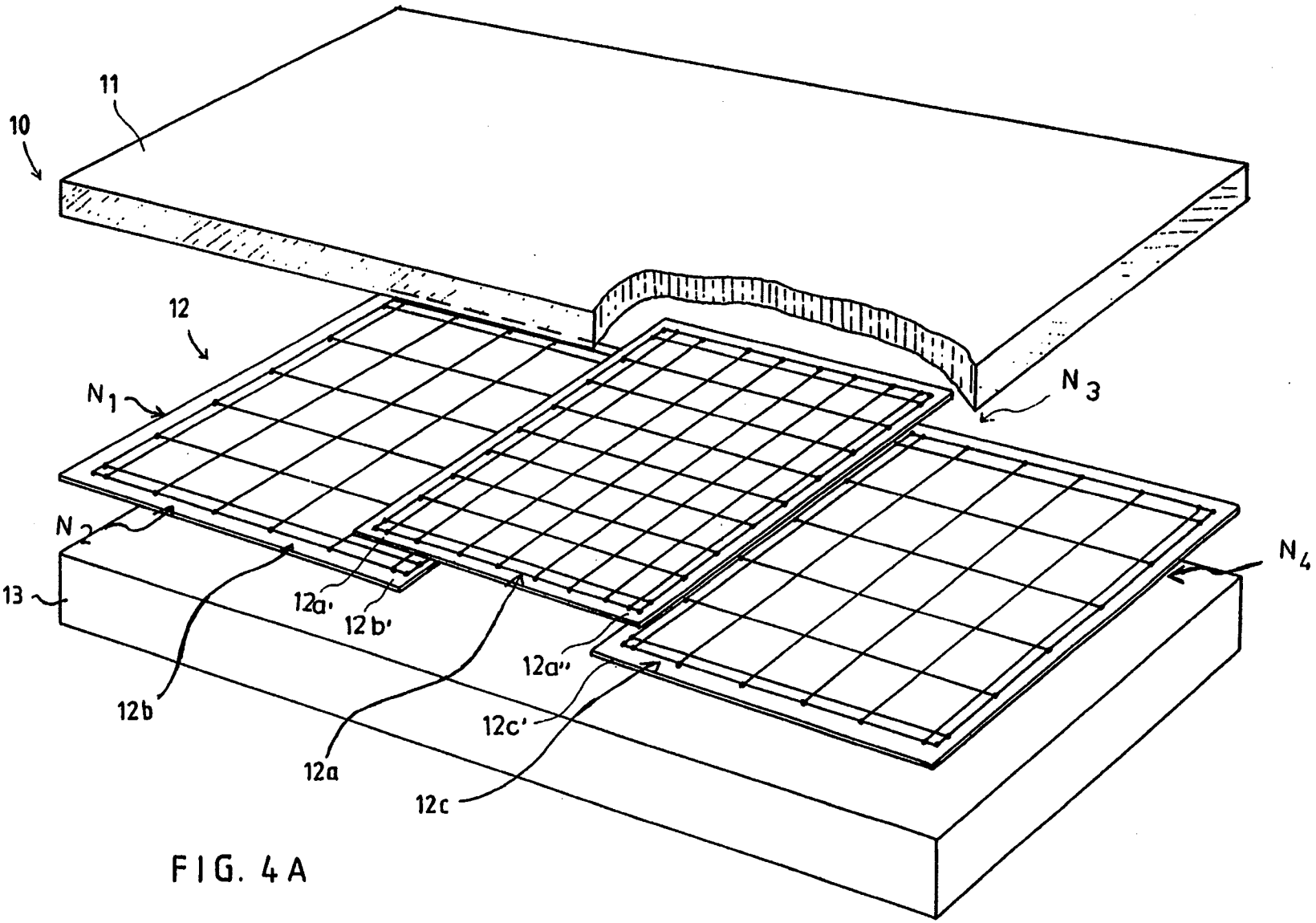
FIG. 4A illustrates an embodiment of the invention in which the intermediate layer consists of three parts, two end parts and a middle part, whose ends overlap each other.

In FIG. 4A, an embodiment is shown in which the intermediate layer 12 is composed of three parts 12*a*,12*b*,12*c* having respective end portions. Ends 12*a*′,-12*a*″ of the middle part 12*a* of the intermediate layer are placed on top of ends 12*b*′,12*c*′ of the lateral parts 12*b*,12*c* of the intermediate layer 12. In this manner, when the mattress is loaded, the ends 12*b*′,12*c*′ of the lateral parts 12*b*,12*c* attempt to raise the ends 12*a*′,12*a*″ of the middle part 12*a* of the intermediate layer, so that the so-called lever effect is increased.

The intermediate layer 12,12′,12″ is preferably made so that it is more rigid in the lateral areas of the intermediate layer than in the middle area of the intermediate layer. Thereby, by means of the intermediate layer, adequate edge support is created for the edge portions of the mattress so that the mattress does not collapse when someone sits on it. To accomplish this, the wires may be more densely spaced in the lateral areas of the intermediate layer, or they may be made of a thicker spring steel wire in the lateral areas $N_1,N_2,N_3,N_4$.

Each intermediate layer 12',12" may have been formed as composed of different intermediate-layer parts 12a,12b,12c, and also possibly so that the spring members 14a,14b are grouped in each intermediate-layer part 12a, 12b, 12c in the manner required for the supporting function of the mattress. For example, one possible way would be to provide the middle part 12a of the intermediate layer with a greater number of spring members than the intermediate-layer parts 12b and 12c placed at the ends of the mattress. The spring members 12 may be installed as fixed, or attached, to a fabric 19 in the manner shown in FIGS. 8A, 8B and 8C.

Figure 4B:
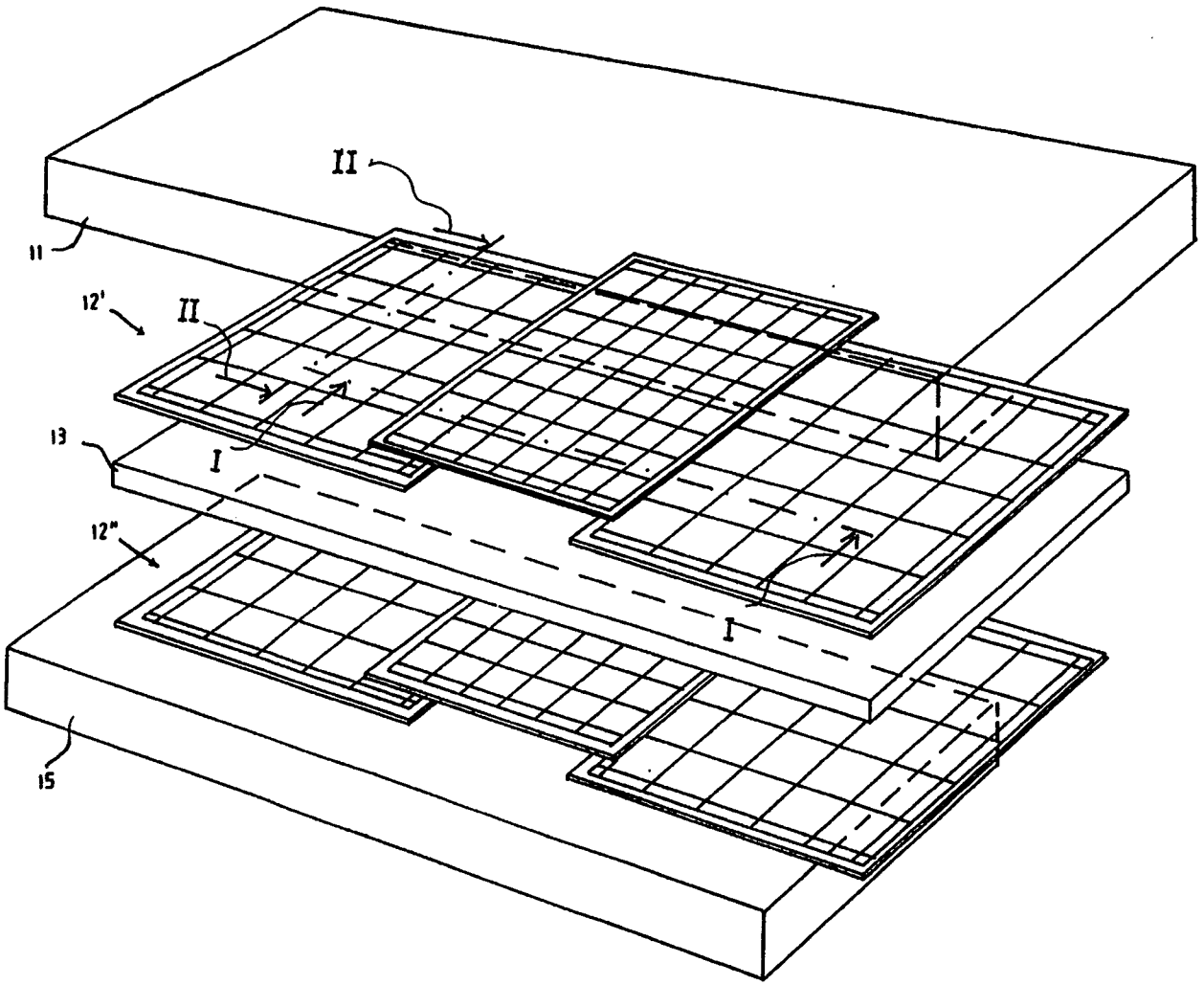
FIG. 4B illustrates a further embodiment of the mattress construction of the invention, in which the mattress comprises two resilient intermediate layers and a layer of soft material arranged therebetween.

FIG. 4B shows an embodiment of the mattress construction of the invention in which the mattress 10 comprises three layers of soft material, a first, second, and third layer 11,13,15 of soft material and two intermediate layers 12' and 12". Between the first and the second layer 11,13 of soft material, there is a more rigid, yet still resilient, lever-action intermediate layer 12' than the layer 12" between the second and the third layer of soft material. The second intermediate layer 12" attempts to increase the support effect of the first intermediate layer 12'. Within the scope of the invention, an embodiment is, of course, possible in which there is an even higher number of intermediate layers and layers of soft material.

Figure 5A:
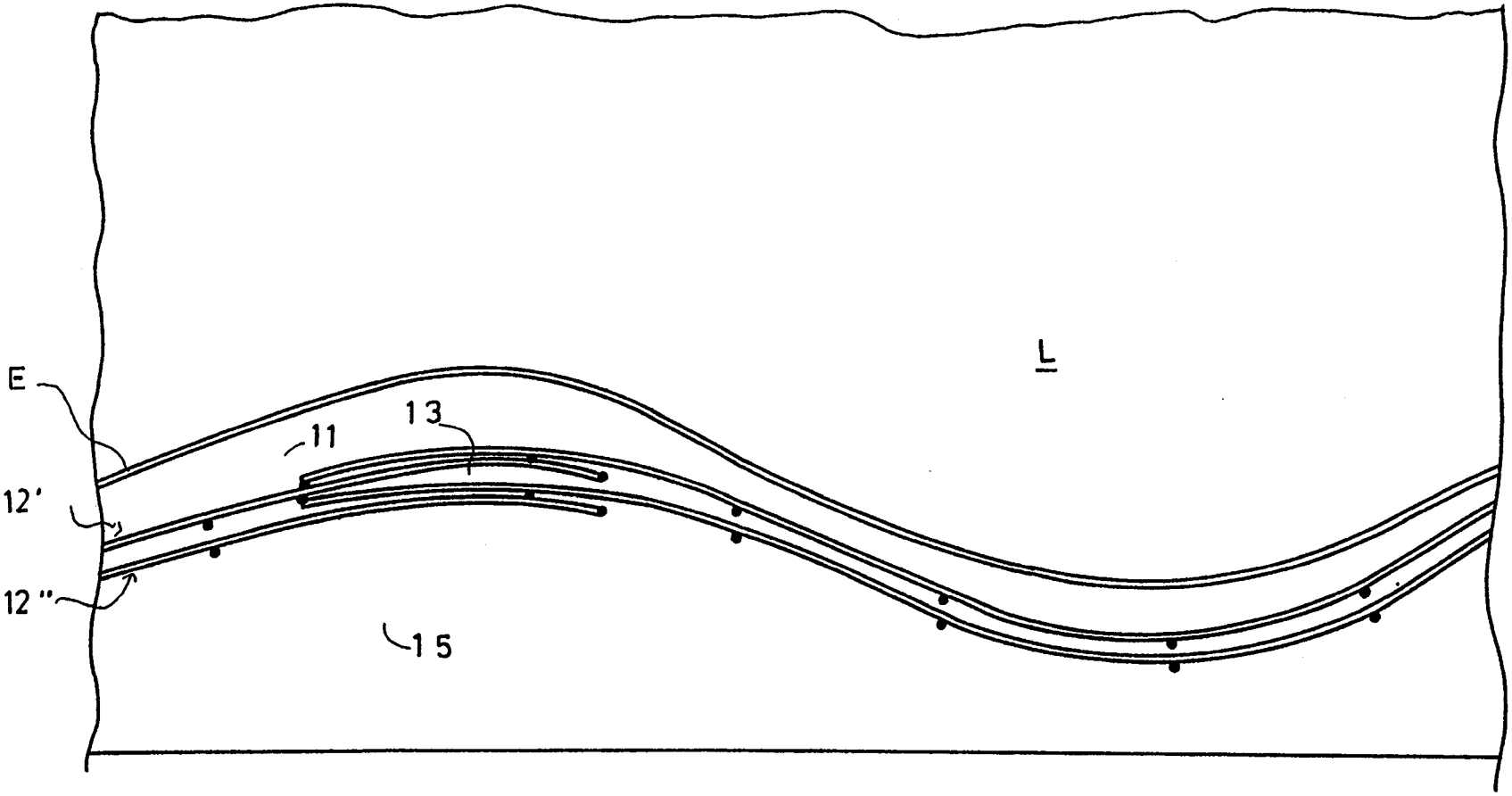
FIG. 5A illustrates the operation of the mattress construction as shown in FIG. 4B in a loading situation shown in a section view taken along the line I—I in FIG. 4B when the mattress is assembled.

FIG. 5A is a sectional view taken along the line I—I in FIG. 4B with the mattress of FIG. 4B assembled. The hip L is the heaviest part of the body and loads the mattress construction with the greatest force. By the effect of the spring and lever action of the intermediate layers 12',12", the upper layer 11 of soft material is deformed so that the shape of the layer 11 of soft material complies with the shape of the body so that the waist part is also supported.

Figure 5B:
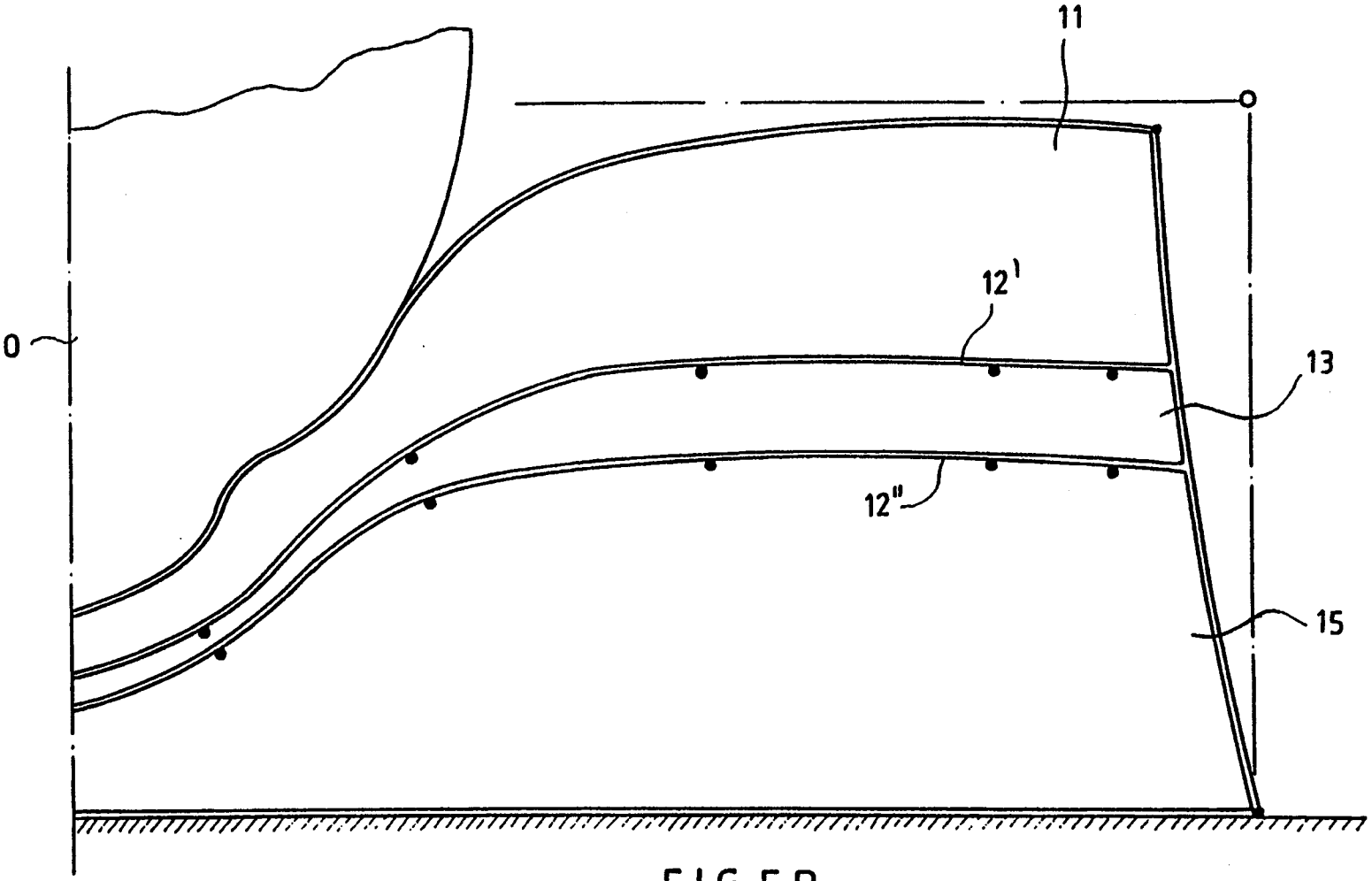
FIG. 5B is a sectional view taken along the line II—II in FIG. 4B when the mattress is assembled and loaded.

FIG. 5B is a sectional view taken along the line II—II in FIG. 4B with the mattress of FIG. 4B assembled. In the cross-sectional view of the load illustrated in the figure, a shoulder 0 of the body on the mattress presses the mattress down. By the effect of the spring action lever-effect described above, the layer 11 of soft material is deformed so that it conforms with the shape of the body O also at the shoulder.

FIG. 6A illustrates the fitting and placement of the support layer into a bag 16 consisting of a fabric K. In this way, transfer of the forces of the intermediate layer 12 from the grille construction, including the spring members, to the layer 11 of soft material is equalized. In addition, damage that might be caused by the spring members 14a,14b in the intermediate layer 14 to the layers 11 and 13 of soft material, such as foamed plastic, is prevented. The bag construction 16 can also be fitted readily between the layers 11,13 of soft material.

Figure 6B:
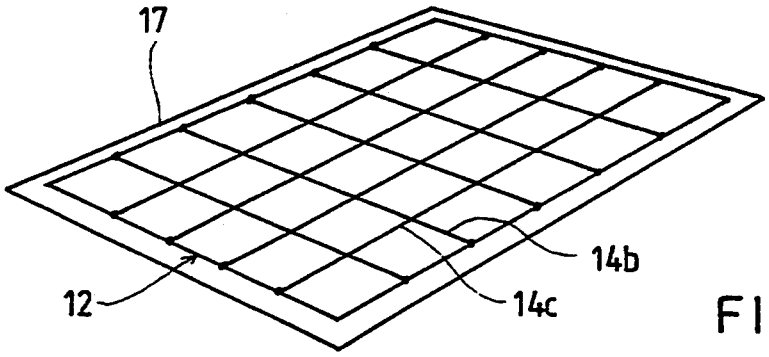
FIG. 6B illustrates the lining of the grille construction consisting of spring members with non-woven fabric in a mattress in accordance with the invention.

FIG. 6B illustrates a suitable lining of the intermediate layer 12, e.g., with a fabric, preferably with a non-woven fabric 17. The lining 17 is arranged on the periphery of the intermediate layer.

Figure 6C:
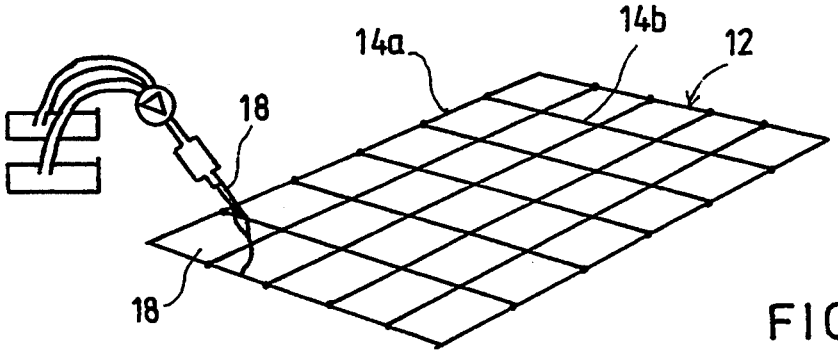
FIG. 6C illustrates the lining of the grille construction in the intermediate layer with foamed plastic, preferably with polyurethane foam in a mattress in accordance with the invention.

FIG. 6C illustrates the lining of the intermediate layer 12 with foamed or cellular plastic 18, preferably with polyurethane foam. In this manner, the grille construction including the spring members 14a,14b, is formed into a unified intermediate layer 12 covered with cellular plastic. Thus, the layer distributes the applied loads uniformly to the upper layer 11 of soft material. The spring members 14a,14b in the intermediate layer 12 are placed inside a protective polyurethane element 18.

Figure 7A:
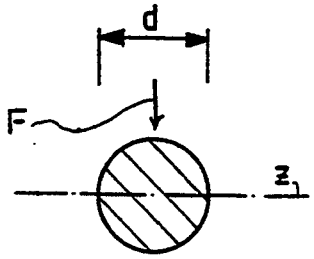
FIG. 7A illustrates the moment of inertia of the cross-section of a spring member in the intermediate layer with respect to the axis Z of bending in a mattress in accordance with the invention.
Figure 7B:
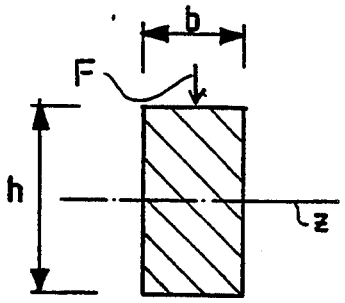
FIG. 7B illustrates the moment of inertia of a spring member in the intermediate layer with respect to the axis Z of bending. The spring member being, in this particular case, a flat bar steel.

FIGS. 7A and 7B are exemplifying illustrations of an embodiment of the components of an intermediate layer in a mattress according to the present invention.

FIG. 7A illustrates the moment of inertia of a spring-steel wire of circular section with respect to the central axis Z when the load is parallel to the arrow F and vertical. The equation to calculate the moment of inertia (J) is thus $J=0.05\cdot d^4$, where d is the diameter of the circular section of the spring member.

FIG. 7B illustrates the moment of inertia of a spring member 14a and/or 14b of rectangular section with respect to the central axis Z when the load is parallel to the arrow F, i.e., the vertical direction. The equation to calculate the moment of inertia (J) is thus $J=(h^3\cdot b)/12$ wherein h is the height of the flat bar steel and b is the width of the flat bar steel. If the spring member has a non-circular or non-rectangular shape, the moment of inertia can be calculated by a known formula for the particular shape of the spring member.

Thus, FIGS. 7A and 7B illustrate the moments of inertia when the intermediate layer 12 consists of spring members having a circular cross-section or rectangular cross-section. For example, assume the person who loads the mattress weighs between about 60 kgs and about 100 kgs, there are two intermediate layers 12' and 12" in the embodiment of the mattress, and the distance between the spring wires in the longitudinal and transverse direction is about 76 mm, and about 70 mm, respectively. Also, assume the diameter $\phi$ of the spring steel wire is about 1.5 mm in the upper intermediate layer 12'. In the lower layer 12", the diameter $\phi$ of the spring steel wire is about 1 mm. In such a case, the moments of inertia obtained for each spring steel wire is about 0.253 $mm^4$ in the upper intermediate layer 12' and about 0.05 $mm^4$ in the lower intermediate layer.

In a corresponding manner, if flat steel bars are used as the spring members, and in the upper intermediate layer a flat steel bar steel is used whose height is about 1.2 mm and width is about 1.8 mm, and in the lower layer a flat steel bar whose height is about 0.8 mm and width is about 1.2 mm, then the moment of inertia of the spring member in the upper layer is about 0.259 $mm^4$, and the moment of inertia of the spring member in the lower intermediate layer 12" is about 0.05 $mm^4$. The tensile strength of the spring steel wire is about 2100 $N/mm^2$ and its modulus of elasticity is E is about 206,000 $N/mm^2$.

Figure 8A:
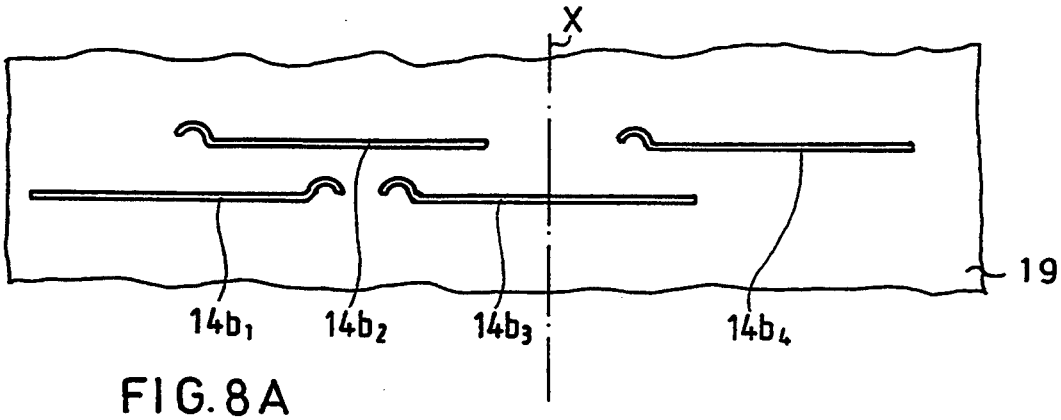
FIG. 8A illustrates spring members in the intermediate layer which are interlocked with each other and placed in the transverse direction in a mattress construction in accordance with the invention. The spring members are attached to the fabric connected with them at least at one point, whereby movement of the spring members during bending is prevented.
Figure 8B:
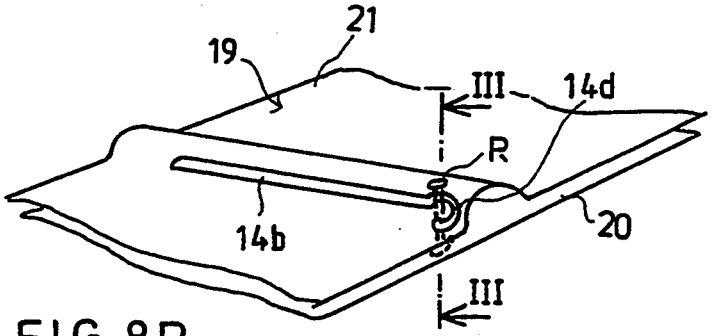
FIG. 8B illustrates the step of fixing, or attaching, a spring member as shown in FIG. 8A between two fabrics by riveting.

FIGS. 8A and 8B show an embodiment of the invention that is particularly well suited for a wider bed. In such a case, a fabric 19 comprises fabric layers 20 and 21. The spring members $14b_1$, $14b_2$, . . . are placed between layers 20,21 and are arranged to be interlocked with each other across the width of the mattress. FIG. 8B illustrates the fixing and connection of a spring member 14b to the fabric structure at one point. An end 14d of the spring member 14b includes a hook-shaped bending having a loop through which a rivet R or equivalent is passed. The rivet R is passed through the fabrics 20,21. Thus, each spring member 14b is kept in its position in relation to the fabric 19.

Figure 8C:
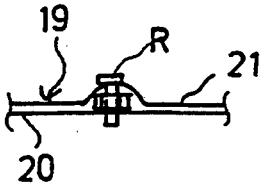
FIG. 8C is a sectional view taken along the line III—III in FIG. 8B.

FIG. 8C is a sectional view taken along the line III—III in FIG. 8B. The rivet R, or equivalent attachment means, is passed through the loop 14d of the spring member 14b and through the upper fabric 20 and the lower fabric 21.

The examples provided above are not meant to be exclusive. Many other variations of the present invention would be obvious to those skilled in the art, and are contemplated to be within the scope of the appended claims.

I claim:

1. A mattress, comprising a first layer of soft material, an intermediate layer having a periphery enclosing an area, said intermediate layer underlying at least a portion of said first layer of soft material and being deformable in response to a load applied onto the mattress at a loading point, a second layer of soft material for supporting said first layer of soft material and said intermediate layer, the material of said second layer supporting and extending beneath the entire area of said intermediate layer, said intermediate layer comprising means for causing a lever effect between said first and second layers of soft material to transfer forces arising from the load to other locations at sides of the loading point to raise the mattress at said other locations by the lever effect and to thereby shift some of the vertical force effect of the load in a lateral direction, said intermediate layer means comprising a grille construction having elongate spring members, a first portion of said spring members being oriented substantially in a longitudinal direction of the mattress and a second portion of said spring members being oriented substantially in a transverse direction of the mattress.

2. The mattress of claim 1, further comprising an edge wire which defines ends of said intermediate layer, said spring members being attached to said edge wire.

3. The mattress of claim 1, wherein said intermediate layer comprises at least three intermediate-layer parts arranged such that ends of said at least three intermediate-layer parts overlap one another.

4. The mattress of claim 1, further comprising a third layer of soft material, and an additional intermediate layer arranged between said second layer of soft material and said third layer of soft material.

5. The mattress of claim 4, wherein said first intermediate layer has a higher rigidity than said second intermediate layer.

6. The mattress of claim 1, wherein said spring members are steel wires having a circular cross-sectional shape.

7. The mattress of claim 6, wherein said steel wires are spring steel wires.

8. The mattress of claim I, wherein said spring members are lamellar members made of flat steel bar.

9. The mattress of claim 8, wherein said flat steel bar is spring steel.

10. The mattress of claim 1, further comprising a fabric bag having an interior in which said intermediate layer is placed.

11. The mattress of claim 1, wherein said spring members are lined with foamed plastic or polyurethane foam.

12. The mattress of claim 1, wherein said spring members are lined with a fabric.

13. The mattress of claim 1, wherein lateral areas of said intermediate layer have a higher rigidity than a middle area of said intermediate layer to thereby form an adequate lateral support at edges of the mattress.

14. The mattress of claim 1, wherein said intermediate layer is arranged in contact with at least one of said first and second layers of soft material to thereby provide a smooth and free deformation movement of said intermediate layer.

15. The mattress of claim 1, wherein an upper layer and a lower layer of soft material are arranged on opposite sides of said intermediate layer by spraying foamed plastic to said opposite sides of said intermediate layer in a mold.

16. The mattress of claim i, wherein said intermediate layer further comprises a fabric contacting said spring members and attachment means to attach said spring members to said fabric.

17. The mattress of claim 16, wherein said attachment means comprise rivets.

18. A mattress, comprising a first and second layer of soft material, an intermediate layer arranged between said first and second layers, said intermediate layer being deformable in response to a load applied onto the mattress at a loading point, said intermediate layer comprising means for causing a lever effect between said first and second layers of soft material to transfer forces arising from the load to other locations at sides of the loading point to raise the mattress at said other locations by the lever effect and to thereby shift some of the vertical force effect of the load in a lateral direction, said intermediate layer means comprising an edge wire which defines ends of said intermediate layer and spring members attached to said edge wire.

19. A mattress, comprising first, second and third layers of soft material, a first intermediate layer arranged between said first layer of soft material and said second layer of soft material, and a second intermediate layer arranged between said second layer of soft material and said third layer of soft material, said first and second intermediate layers being deformable in response to a load applied onto the mattress at a loading point, said intermediate layers comprising means for causing a lever effect between said first and second layers of soft material to transfer forces arising from the load to other locations at sides of the loading point to raise the mattress at said other locations by the lever effect and to thereby shift some of the vertical force effect of the load in a lateral direction.

20. The mattress of claim 19, wherein said first intermediate layer has a higher rigidity than said second intermediate layer.

21. A mattress, comprising a first and second layer of soft material, an intermediate layer comprising spring members arranged between said first and second layers, said intermediate layer being deformable in response to a load applied onto the mattress at a loading point, said intermediate layer comprising means for causing a lever effect between said first and second layers of soft material to transfer forces arising from the load to other locations at sides of the loading point to raise the mattress at said other locations by the lever effect and to thereby shift some of the vertical force effect of the load in a lateral direction, and a fabric bag having an interior for receiving said intermediate layer such that loads applied by said spring members to said first and second layers of soft material are equalized.

* * * * *